United States Patent [19]

Abraham

[11] 4,265,092

[45] May 5, 1981

[54] REFRIGERATED DISPLAY CASE USING AIR DEFROST WITH SUPPLEMENTAL HEATER

[75] Inventor: Fayez Abraham, Niles, Mich.

[73] Assignee: Tyler Refrigeration Corporation, Niles, Mich.

[21] Appl. No.: 107,261

[22] Filed: Dec. 26, 1979

[51] Int. Cl.[3] ..... F25D 21/08

[52] U.S. Cl. ..... 62/155; 62/176 A; 62/234; 62/256; 62/276

[58] Field of Search ..... 62/255, 256, 80, 82, 62/282, 155, 176 A, 234, 276

[56] References Cited

U.S. PATENT DOCUMENTS

| | | | |
|---|---|---|---|
| 3,063,254 | 11/1962 | Dickson et al. | 62/256 |
| 3,128,609 | 4/1964 | Beckwith et al. | 62/256 |
| 3,333,437 | 8/1967 | Brennan | 62/155 X |
| 3,850,003 | 11/1974 | Beckwith et al. | 62/282 X |
| 3,937,033 | 2/1976 | Beckwith et al. | 62/155 |
| 4,026,121 | 5/1977 | Aokage et al. | 62/256 X |
| 4,144,720 | 3/1979 | Subera et al. | 62/256 |
| 4,148,197 | 4/1979 | Karashima | 62/282 X |

*Primary Examiner*—William E. Tapolcai, Jr.
*Attorney, Agent, or Firm*—LeBlanc, Nolan, Shur & Nies

[57] ABSTRACT

A refrigerated display cabinet of the open top or open front type having a conduit extending around a storage and display space in the cabinet between an inlet and an outlet, refrigerated coils located in the conduit, air circulating fans for propelling air through the conduit over and/or around and/or through the refrigeration coils in a first direction during a refrigeration cycle, and in a second substantially opposite direction, during a defrost cycle, whereby during a defrost cycle ambient air is drawn into the conduit through the outlet and is passed around and/or through the refrigeration coils to defrost same, a supplemental defroster located in the conduit upstream of the refrigeration coils in the direction of air flow through the conduit in the defrost cycle; and, a sensing and control mechanism coupled with the supplemental defroster for sensing defrost conditions during the defrost cycle and for energizing the supplemental defroster means upon the detection of an abnormal defrost condition to thereby accelerate the rate of defrost.

4 Claims, 3 Drawing Figures

REFRIGERATED DISPLAY CASE USING AIR DEFROST WITH SUPPLEMENTAL HEATER

BACKGROUND OF THE INVENTION

This invention relates to refrigerated display cases, and more particularly to apparatus for defrosting evaporator coils contained in the display case.

The invention is primarily but not exclusively directed to refrigerated display cases manufactured and sold mainly for use in food stores, such as supermarkets, convenience store outlets, combination food and department stores, hypermarkets, etc.

Commercial refrigeration systems for use in consumer retail outlets of the aforementioned type generally comprise a plurality of display cases, each having its own set of cooling coils and associated air propulsion and control means to move air over, around and/or through the cooling coils and the display case to maintain the desired cold temperature. The cooling coils are connected, in a known manner, by connecting conduits to a centrally located mechanical system including one or more compressors, condensors and associated equipment for supplying liquid refrigerant to the cooling coils in the individual cases.

Periodically, the cases must be defrosted to clear accumulations of ice or snow away from the cooling coils. Three principal types of defrosting techniques are generally employed on commercial refrigeration units. One common type utilizes high wattage electrical heaters adjacent the cooling coils; these heaters are activated during the defrost mode to radiate heat and warm the cooling either directly or by warming the air stream passing over or through the coils. A second type of defrosting means, less common because of its complexity than electric defrost, employs heated refrigerant gas which is circulated through the cooling coils during the defrost mode, usually in the reverse direction to normal refrigeration flow.

Electric defrost and hot gas defrost techniques have commercial disadvantages. Electric defrost requires substantial power consumption and is therefore relatively expensive to operate. Hot gas defrost requires additional valving and conduit connections, greater initial capital outlay and more long term maintenance.

The third main type of defrost technique used increasingly in commercial refrigeration systems employs ambient air circulating through the air flow system during the defrost mode. The ambient air, which is substantially warmer than the refrigerated air, is passed over the cooling coils to warm them sufficiently to defrost them. Air defrost systems in general are known; see for example U.S. Pat. No. 4,144,720 Mar. 20, 1979 to Elmer J. Subera, Melvin W. Steelman and Fayez Abraham and assigned to Tyler Refrigeration Corporation. Air defrost techniques, particularly of the type disclosed in the Subera et al '720 patent, have significant mechanical and operating advantages over hot gas defrost and electric defrost techniques. The air defrost technique does not require the additional piping and valving components of a hot gas defrost system and does not require the high power consuming heater wires of the electric defrost system.

Air defrost utilizes heat extracted from the air in two forms; sensible heat is extracted by dropping the air temperature and latent heat is released through the cooling coil area through the condensation of water vapor in the air. As a rule of thumb, moisture released about 1300 BTUs per pound when condensed. It has been found that under certain store conditions of temperature and humidity, the air defrost method alone may not be completely adequate to defrost the cooling coils of certain types of frozen food cases rapidly enough to prevent partial defrosting and spoilage of food products stored in the case.

In some environmental conditions, the ambient humidity in the store will be relatively low. Under such low humidity conditions, not enough latent heat can be extracted from the air to defrost the cooling coils in a sufficiently short period of time to prevent the ice cream from melting. It has been found that, at such times, air defrost techniques alone are not completely effective to defrost ice cream containing cases without suffering a certain amount of product spoilage due to defrosting and refreezing of the ice cream.

It is desirable to utilize the air defrost technique because, of the three main types of defrost techniques, it is the most energy efficient (as well as having other advantages as noted above). It is also desirable and economically and commercially necessary to defrost refrigerated display cases quickly to prevent undesirable defrosting of the products stored in the display case. This problem has been addressed previously, in U.S. Pat. No. 4,145,893 issued Mar. 27, 1979 to Vogel. The Vogel '893 patent discloses a refrigerated display case having a control circuit for diverting electrical energy from anti-sweat heater wires (which operate during the refrigeration mode) to a cooling coil heater which operates during the defrost mode. According to Vogel, the anti-sweat heater wires, which are generally located adjacent duct outlets or inlets to inhibit condensation collection in those areas, are shut off as soon as the display case control system switches from refrigeration mode to defrost mode. At the same time, the control circuit switches on the cooling coil heater unit to warm air being propelled over and through the cooling coils by the display case fans. Vogel's cooling coil heater unit is always turned on at the start of a defrost cycle and remains on for the entire defrost cycle.

The present invention has certain advantages over the type of defrost technique described in the Vogel '893 patent. The invention described here utilizes a supplemental electric heater and heater control, the operation of which depends only on monitored defrost conditions. The supplemental defrost heater is controlled to operate only when necessary to assist the normal air defrost cycle. If ambient temperature and humidity conditions are such that the defrost cycle will be completed within the required time by air defrost alone, the supplemental defrost heater will not be activated at all. On the other hand, if the heater control detects a low humidity condition at any time during the defrost cycle or detects that the defrost cycle is taking too long, the control will energize the supplemental heater to speed up the defrost cycle only for that portion of the defrost cycle during which the abnormality is detected.

SUMMARY OF THE INVENTION

A refrigerated display cabinet of the open top or open front type having a conduit extending around a storage and display space in the cabinet between a inlet and an outlet, refrigeration coils located in the conduit, air circulating fans for propelling air through the conduit over and/or around and/or through the refrigeration coils in a first direction during a refrigeration cycle, and in a second, substantially opposite direction, during a defrost cycle, whereby during a defrost cycle ambient air is drawn into the conduit through the outlet and is passed around and/or through the refrigeration coils to defrost same, a supplemental defroster located in the conduit upstream of the refrigeration coils in the direction of air flow through the conduit on the defrost cycle; and, a sensing and control mechanism coupled with the supplemental defroster for sensing defrost conditions during the defrost cycle and for energizing the supplemental defroster means upon the detection of an abnormal defrost condition to thereby accelerate the rate of defrost.

The supplemental defroster may comprise an electrical heater, the sensing and control means may detect relative humidity in the ambient air and energize the supplemental defrost heater only when the detected relative humidity falls below a predetermined level; or the sensing and control means may detect the duration of the defrost cycle and energize the supplemental defrost heater only when the detected length of the defrost cycle exceeds a predetermined duration.

DESCRIPTION OF THE PREFERRED EMBODIMENTS

The present invention is applicable to a number of different case designs for different uses. The invention is particularly, but not exclusively, well suited for frozen food type cases, such as those used to store and display ice cream and similar products.

In general, there are two common basic styles of refrigerated display cases. In the first type, called open-top or well-type, the access opening may lie in a substantially horizontal plane or the access opening may be angled slightly downwardly from front to rear to present a slanted opening to the customer. The second basic style of case is the upright, or open-front type in which the access opening lies in a substantially vertical plane. Examples of well-type and open-front incorporating the features of this invention are described below.

Figure 1:
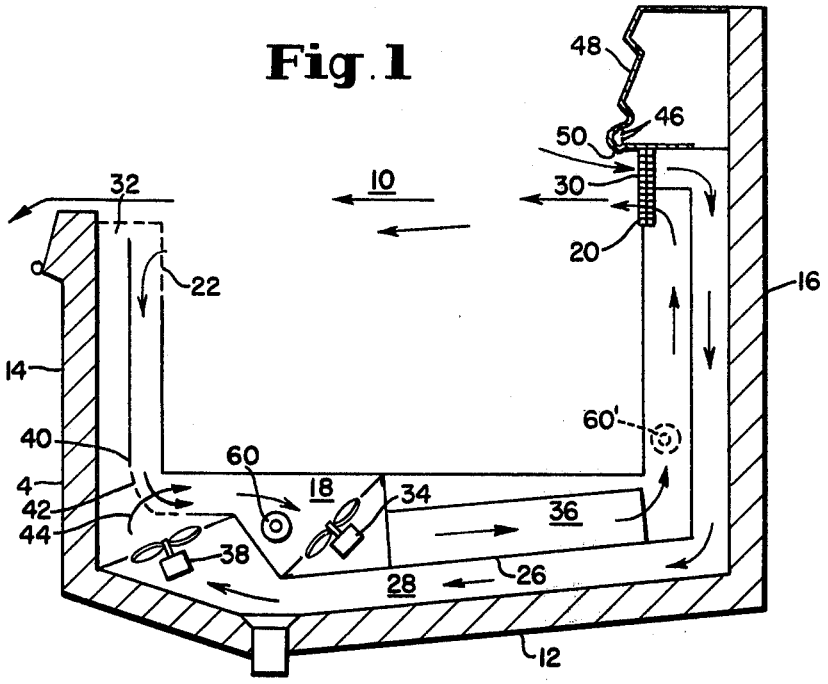
FIG. 1 is a cross-sectional view of an open top or well-type refrigerated display case incorporating features of this invention.

Referring to FIG. 1, the well-type display case 4 has an open top 10 to permit access to products within the display case, a bottom 12, and opposing front and rear walls 14 and 16, respectively. The sides, or end walls, of case 4 are not shown. An inner or primary air conduit 18, which is approximately U-shaped, extends around the front, bottom and rear of the display case. Inner air conduit 18 has an air outlet opening 20 at one end and an air inlet opening 22 at its opposite end. Openings 20 and 22 are arranged at opposite sides of the open top display case. The openings 20 and 22 are so constructed and aligned that air expelled through outlet opening 20 is directed across the open top of the display case and received by inlet opening 22 so as to re-enter the conduit 18.

Surrounding inner air conduit 18, and separated therefrom by a common divider wall 26, is an outer or secondary air conduit 28, which is also approximately U-shaped between its ends. Outer air conduit 28 has an air outlet opening 30 at one end and an air inlet opening 32 at its opposite end, with such openings being arranged at opposite sides of the open top of the display case. As with openings 20 and 22, openings 30 and 32 are so constructed and aligned that air expelled through outlet opening 30 is directed across the open top towards inlet opening 32 to re-enter the conduit 28.

At least one fan 34 is located within inner air conduit 18 as an air propelling means. The number of fans can vary depending, for example, on the size of the display case and the size of the fans. Also positioned within inner air conduit 18 is one or a plurality of sets of evaporator coils, such as represented by box 36. In the refrigeration mode, refrigerant flows through the coils 36 to cool the air being circulated through conduit 18 and over and through the evaporator coils. In the defrost mode, means are provided to temporarily shut off the flow of refrigerant through coils 36, in known manner.

One or more fans 38 are arranged within conduit 28 for circulating air through conduit 28. The number of fans varies depending, for example, on the size of the display case and the size of the fans.

In the refrigeration mode, a continuous primary refrigerated air band is established across the open top of case 4 between the air outlet 20 and air inlet 22. An outer guard band of cool but unrefrigerated air is established across the open top of case 4 between the air outlet 30 and air inlet 32.

When the refrigerated case enters the defrost mode (e.g. as controlled by a timer or ice sensor, in known fashion), the direction of air flow through at least one of the two air flow conduits may be reversed and air warmer than the refrigerated air, e.g., ambient air, is caused to flow through the inner air conduit. For example, the direction of air flow through inner air conduit 18 may be maintained in the same direction as during the refrigeration mode while the air flow direction through outer air conduit 28 is reversed. Alternately, the air flow through inner conduit 18 may also be reversed, whereby both bands operate in reverse air flow direction in the defrost mode. As noted above, evaporator coils 36 are deactivated during the defrost period so that air passing through conduit 18 is not refrigerated.

In the embodiment shown here, a portion 40 of common wall 26 contains a plurality of perforation 42. During the defrost mode, as the warmer ambient air is drawn into conduit 28 through outlet 30, it is circulated in a reverse direction through conduit 28 and is sucked into inner air conduit 18, as represented by arrow 44. This air flows into inner air conduit 18 from outer air conduit 28 and then blends with the air flowing through the inner air conduit, thereby increasing the temperature of the inner air.

Figure 2:
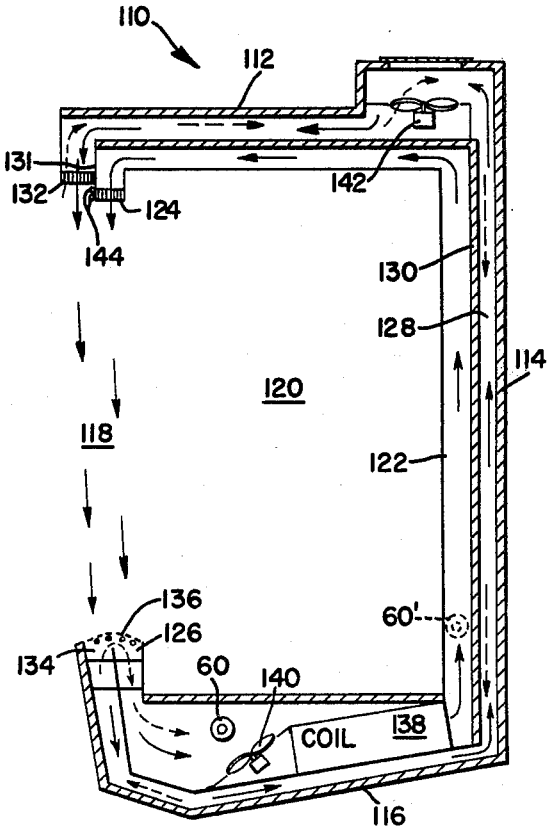
FIG. 2 is a cross-sectional view of an upright or open-front type of refrigerated display case incorporating features of this invention.

An example of an upright refrigerated display case is shown in FIG. 2. The display cabinet, generally designated 110, comprises a top portion 112, a rear portion 114, a bottom portion 116, and an open front 118, permitting access to an inner display area or space 120. The display space is bounded on the sides by a pair of end walls (not shown). Shelves (not shown) may be mounted, preferably adjustably, on suitable uprights fixed to or made an integral part of the interior wall of rear portion 114, in a conventional manner.

The display cabinet 110 houses an inner or primary air conduit 122 having an air outlet opening 124 and an air inlet opening 126 arranged along opposite perimeters of the access opening 118. The cabinet 110 further houses an outer or secondary air conduit 128 adjacent to inner air conduit 122 and separated therefrom by a common divider wall 130. Conduit 128 terminates at its respective end portions in an air outlet opening 132 and an air inlet opening 134 arranged along the top and bottom perimeters, respectively, of the access opening 118.

Inner conduit outlet 124 may be located below the outer outlet opening 132. Inlet openings 126 and 134 generally share a common cover grill 136. The outlet openings 124 and 132 are preferably aligned with their respective outlet openings 126 and 134 so that air exiting from the outlet openings is propelled downwardly across the access opening 118 in the form of inner and outer air curtains toward and into respective inlet openings, as indicated by the solid line arrows in FIG. 2.

One or more sets of evaporator coils 138 is located in conduit 122. Also located in conduit 122 is an air propelling means, in the form of one or more fans 140. A corresponding air propelling means, in the form of one or more fans 142, is located in conduit 128. (The number of fans used is a function of the size of the case, as is well known to those skilled in the pertinent art). One or both sets of fans 140 and 142 is preferably of the reversing motor type.

During the normal refrigeration cycle, fans 140 and 142 propel air through conduits 122 and 128, respectively, in the direction shown by the solid line arrows. In one embodiment, when the defrost mode is triggered, fan motors 142 are controlled to reverse their direction of rotation. The air flow direction in the secondary band 128 is therefore reversed during the defrost cycle; as indicated by the dashed line arrows, ambient air is drawn into the secondary band conduit through outlet 132 and exits the secondary band conduit 128 through inlet 134. Substantially all of the secondary conduit air exiting inlet 134 is immediately sucked back into the primary band conduit 122. For further details of an example of the defrost mode operation of this embodiment, reference is made to the disclosure of the aforementioned U.S. Pat. No. 4,114,720, which is incorporated in its entirety by reference.

Frozen food (e.g. ice cream storage/display) cases, to which this invention is primarily directed, may employ one or more anti-sweat heater wires located adjacent the air conduit outlet opening(s) and/or the air conduit inlet opening(s). In the embodiment shown in FIG. 1, anti-sweat heater wires 46 are located inside a rear riser 48 of the case 4, in the region 50 which overlies the air outlet grills of conduit 18 and 28. Heater wires 46 prevent condensation (in the form of frost) from building up on the surface of riser portion 50.

In an upright case, of the type shown in FIG. 2, one or more anti-sweat heater wires 144 may be located on an extended portion 131 of the common wall 130, since this is a likely location for frost build-up in the refrigeration mode. Heater wires 144 are therefore employed to prevent such frost build-up.

Having described examples of suitable environments therefor, the subject matter of this invention will be described in detail below with reference to FIGS. 1 and 2, wherein like reference numerals in both figures refer to the same or similar parts.

This invention relates primarily to the addition of a supplemental demand heater to be utilized during the defrost cycle of a refrigerated display cabinet and particularly, such cabinets which employ air defrost principles, as described, for example, in the above Tyler '720 patent.

The supplemental heat source for this invention comprises an elongated heater 60, such as a calrod heating element. Heating element 60 is located in the primary air flow conduit (18 and 122 in FIGS. 1 and 2, respectively) upstream of the evaporator coils (36 and 138 in FIGS. 1 and 2, respectively), considered in the air flow direction in the defrost cycle. Thus, heating element 60 is shown positioned in FIGS. 1 and 2 for systems in which the primary band fans are not reversed during the defrost cycle as compared to the refrigeration cycle. Elements 60' are shown in phantom in FIGS. 1 and 2 located upstream of the evaporator coils for systems in which the primary band fans are reversed during the defrost cycle.

The supplemental heater 60 is controlled independently of the operation of anti-sweat wires. The supplemental heater 60 may be energized in any one of several ways to aid in the rapid defrosting of the evaporator coils. In one embodiment, the supplemental heater 60 may be energized by a control which senses the moisture content in the air; one such control device is marketed by Minneapolis Honeywell Company as "Dew Point Controller 4-409A". The dew point controller measures the moisture content in the air; when the measured humidity is below a preset limit, indicating low moisture content condition, and thus low latent heat available for defrosting, the supplemental heater 60 will be energized.

For example, supplemental heat may be required when the measured dew point temperature is below 35° F.

In the alternative embodiment, the dew point or demand controller may be replaced by a timer controlled device; for example, if the defrost cycle does not terminate within a predetermined time, for example, after 30–35 minutes, the controller will then energize the supplemental heater 60 to speed up the defrost cycle.

Figure 3:
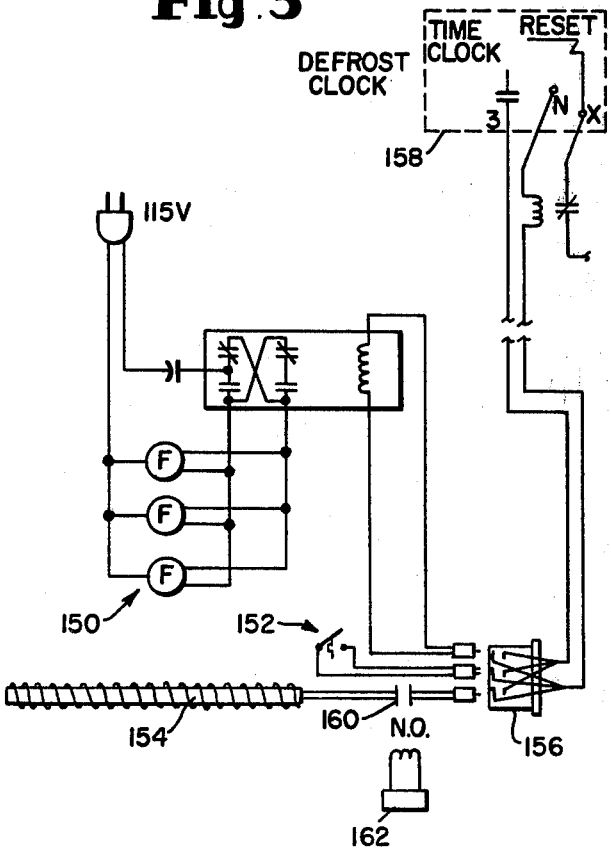
FIG. 3 is a schematic showing the electrical systems incorporating the supplemental heater of the invention.

In either embodiment, the supplemental heater 60 and the heater controller are electrically connected to the defrost controller. Referring to FIG. 3, reversible fan motors 150, a defrost limit switch 152, and a supplemental heater 154 are connected through a multi-socket plug 156 to a defrost controller 158. A normally open relay 160 controls operation of the supplemental heater when the defrost cycle is activated by controller 158. A dew pointer or timer 162 closes relay 160 when an abnormal defrost condition is detected.

The supplemental heater 60 is energized only during the defrost cycle and then only when the necessary condition (e.g. low moisture content or excessive defrost time) is detected. In this way, supplemental defrost heat is added only when necessary during defrost and only during defrost, thereby resulting in a significant contribution to energy conservation.

The above-described examples of open top and open front cases are both of the multi-band type. It will be apparent that this invention is also applicable to single band cases, that is refrigerated display cases utilizing only a single air flow conduit containing the cooling coils and reversible fan(s) (or other equilalent air flow reversing means). One such case, of the open top type, is disclosed in U.S. Patent Application Ser. No. 60,459 filed July 25, 1979 in the name of Fayez Abraham and assigned to Tyler Refrigeration Corporation, the disclosure of said Ser. No. 60,459 is incorporated herein in its entirety by reference.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A refrigerated display cabinet having an access opening for communicating a storage and display space in the cabinet with the ambient atmosphere;

at least one outlet means extending across one edge of said access opening;

at least one corresponding inlet means extending across an opposite edge of said access opening;

conduit means extending from said at least one inlet means around said cabinet to said at least one outlet means;

refrigeration means located in said conduit means;

air circulating means for propelling air through said conduit means over and/or around and/or through said refrigeration means in a first direction during a refrigeration cycle, and in a second direction, substantially opposite said first direction during a defrost cycle, whereby during a defrost cycle ambient air is drawn into said conduit means through said outlet means and is passed over and/or around and/or through said refrigeration means to defrost same;

supplemental defrost means located in said conduit means upstream of said refrigeration means in the direction of air flow through said conduit means in the defrost cycle; and, sensing and control means coupled with said supplemental defrost means for sensing defrost conditions during the defrost cycle and for energizing said supplemental defrost means upon the detection of an abnormal defrost condition to thereby accelerate the rate of defrost.

2. A refrigerated display cabinet having an access opening for communicating a storage and display space within the cabinet with the ambient atmosphere, adjacent first and second outlets extending across one edge of said access opening;

corresponding adjacent first and second inlets extending across an opposite edge of said access opening;

a first conduit extending from said first inlet around said cabinet to said first outlet;

a second conduit extending from said second inlet around said cabinet to said second outlet;

refrigeration means in one of said first and second conduits;

first air circulating means in said one conduit for propelling air over and/or through said refrigeration means to the outlet of said one conduit and across said access opening in the form of a primary air curtain to the inlet of said one conduit;

second air circulating means for directing a flow or air through the other of said first and second conduits in a first direction during the refrigeration cycle and in a second direction, substantially opposite said first direction, during the defrost cycle to draw ambient air into the said other conduit;

means providing a directed air flow path from said other conduit to said one conduit upstream of the refrigeration means during the defrost cycle, whereby during the defrost cycle ambient air is caused to flow from said other conduit into said one conduit and over and/or through said refrigeration means to defrost same;

supplemental defrost means located in said one conduit upstream of said refrigeration means in the direction of air flow through said one conduit in the defrost cycle; and, sensing and control means coupled with said supplemental defrost means for sensing defrost conditions during a defrost cycle and for energizing said supplemental defrost means upon detection of an abnormal defrost condition to thereby accelerate the rate of defrost.

3. A refrigerated display case according to claim 1 or 2, wherein said supplemental defrost means comprises an electrical heater and said sensing and control means comprises means for detecting relative humidity in the ambient air and for energizing said supplemental defrost means only during a defrost cycle when the detected relative humidity falls below a predetermined level.

4. A refrigerated display case according to claim 1 or 2, wherein said supplemental defrost means comprises an electrical heater and said sensing and control means comprises means for detecting the duration of the defrost cycle and for energizing said supplemental defrost means only during the defrost cycle when the detected length of the defrost cycle exceeds a predetermined duration.

* * * * *